US005724819A

United States Patent [19]

Boeckel et al.

[11] Patent Number: 5,724,819

[45] Date of Patent: Mar. 10, 1998

[54] THERMOELECTRIC COOLING CENTRIFUGE

[76] Inventors: John W. Boeckel, 1232 Georgia Hill Rd., Southbury, Conn. 06488; Michael J. Parisi, 5207 Main St., Trumbull, Conn. 06611

[21] Appl. No.: 704,350

[22] Filed: Aug. 28, 1996

Related U.S. Application Data

[63] Continuation-in-part of Ser. No. 476,870, Jun. 7, 1995, Pat. No. 5,551,241, which is a continuation-in-part of Ser. No. 204,561, Mar. 2, 1994, Pat. No. 5,433,080.

[51] Int. Cl.[6] ..... F25B 21/02

[52] U.S. Cl. ..... 62/3.7; 62/3.6; 62/3.2; 494/13; 494/14

[58] Field of Search ..... 62/3.2, 3.3, 3.6, 62/3.7; 494/13, 14

[56] References Cited

U.S. PATENT DOCUMENTS 3,129,174 4/1964 Pickels et al. ..... 494/14
4,193,536 3/1980 Kubota ..... 494/14

*Primary Examiner*—John M. Sollecito
*Attorney, Agent, or Firm*—Eric P. Schelllin

[57] ABSTRACT

A refrigerated centrifuge system. The system includes at least one thermoelectric cooler which is operatively connected to a centrifuge chamber by an egress conduit and an ingress conduit. In one embodiment the egress conduit carries away from the centrifuge to the thermoelectric cooler warm air where it is cooled by the thermoelectric cooler. The cooled air then returns to the centrifuge. In another embodiment the warm air in the centrifuge is first passed through a liquid heat exchanger whereby the warmed air transfers heat to a liquid which then is pumped through an egress conduit to a thermoelectric cooler where the liquid is cooled. The cooled liquid is then pumped back to the liquid heat exchanger through an ingress conduit.

4 Claims, 1 Drawing Sheet

THERMOELECTRIC COOLING CENTRIFUGE

CROSS REFERENCE TO PRIOR APPLICATION

The present patent application is a continuation in part application of Ser. No. 08/476,870 filed on Jun. 7, 1995 now U.S. Pat. No. 5,551,241 which in turn is a continuation in part patent application of Ser. No. 08/204,561 filed on Mar. 2, 1994 now U.S. Pat. No. 5,433,080. The said prior applications are incorporated herein in their entirety by reference.

BACKGROUND OF THE INVENTION

This invention relates to thermoelectric coolers preferably designed for association with of centrifuges or in close proximity therewith. More particularly, the thermoelectric cooler is of the type having a heat sink over which ambient air is driven for the more efficient discharge of energy.

SUMMARY OF THE PRIOR ART

Wedemeyer et al U.S. Pat. No. 4,512,758 discloses the advantage of a nonconducting substrate including a plurality of thermoelectric modules of the Peltier effect type. The substrate with attached thermoelectric modules is clamped to the bottom of a centrifuging chamber on one side. By firmly impressing the chamber onto the heat sinks, efficient thermal conductivity and hence removal of heat from the chamber readily occurs. The device of Wedemeyer et al is slow in moving the heat content across the chamber thereby imposes an appreciable delay in cooling centrifuge rotors to desired centrifuging temperatures.

In a more recent U.S. Pat. No. 4,785,637 to Giebeler, a thermoelectric temperature control assembly is disclosed wherein heat is transferred to or from a heat sink. The heat sink is located below the chamber containing the centrifuge rotor.

Most critically, the efficiency of the thermoelectric cooler is dependent upon the heat discharge from the thermoelectric cooler. Such heat discharge includes heat extracted from the chamber as well as heat produced in the thermoelectric cooler by the Peltier effect. Ordinary heat sinks have been found other than optimum for this required heat discharge effect. As a result, cooling has been undesirably slow.

SUMMARY OF THE INVENTION

A thermoelectric cooling design of the type having thermoelectric coolers. Provisions for a centrifuge chamber and improved heat dissipation from the thermoelectric coolers are provided. For improved thermal response, in one embodiment the refrigerated centrifuge chamber is provided with a pump to drive a liquid eternally of the chamber through suitable conduit means over at least one heat sink mounted externally of the chamber and wherein in a second embodiment the rotor of the centrifuge assists in the transfer of ambient air cyclically.

In other words, a heat discharge heat sink is communicated externally to each thermoelectric cooler module for dissipating heat energy from both the chamber and thermoelectric cooler.

Before centrifugation occurs with many samples, temperature thereof must be precisely controlled. In practice, classification of the sample in a rotor must occur at controlled temperature. An example of such a temperature is 2 Centigrade for certain biological samples. The sample must be brought to the desired temperature and during centrifugation the sample must be maintained at that temperature. In both events cooling of the chamber is required. Due to their small size and weight, thermoelectric devices using the Peltier effect are ideally suited for the procedure.

The chamber is typically produced from relatively pure nonalloyed aluminum of the thinnest size possible to thereby obtain heat conduction through the shortest path possible. A thin wall thickness has the advantage of improving thermal response times. Both the heat capacity of the chamber and the thermal gradient produced by the chamber in cooling the rotor are reduced.

Thermoelectric modules require high thermal conductivity between heat sinks and discharge heat sinks. At the interface between a thermoelectric module and discharge heat sink, a critical high flow heat discharge junction is defined.

In the present emphasis both the module heat sinks and discharge heat sinks are external of the centrifuge chamber, connection with the centrifuge chamber being established by egress conduit and ingress conduit.

BRIEF DESCRIPTION OF THE DRAWINGS.

Other objects, features, and advantages will become more apparent after referring to the following specification and attached drawing in which.

DETAILED DESCRIPTION OF THE INVENTION

Figure 1:
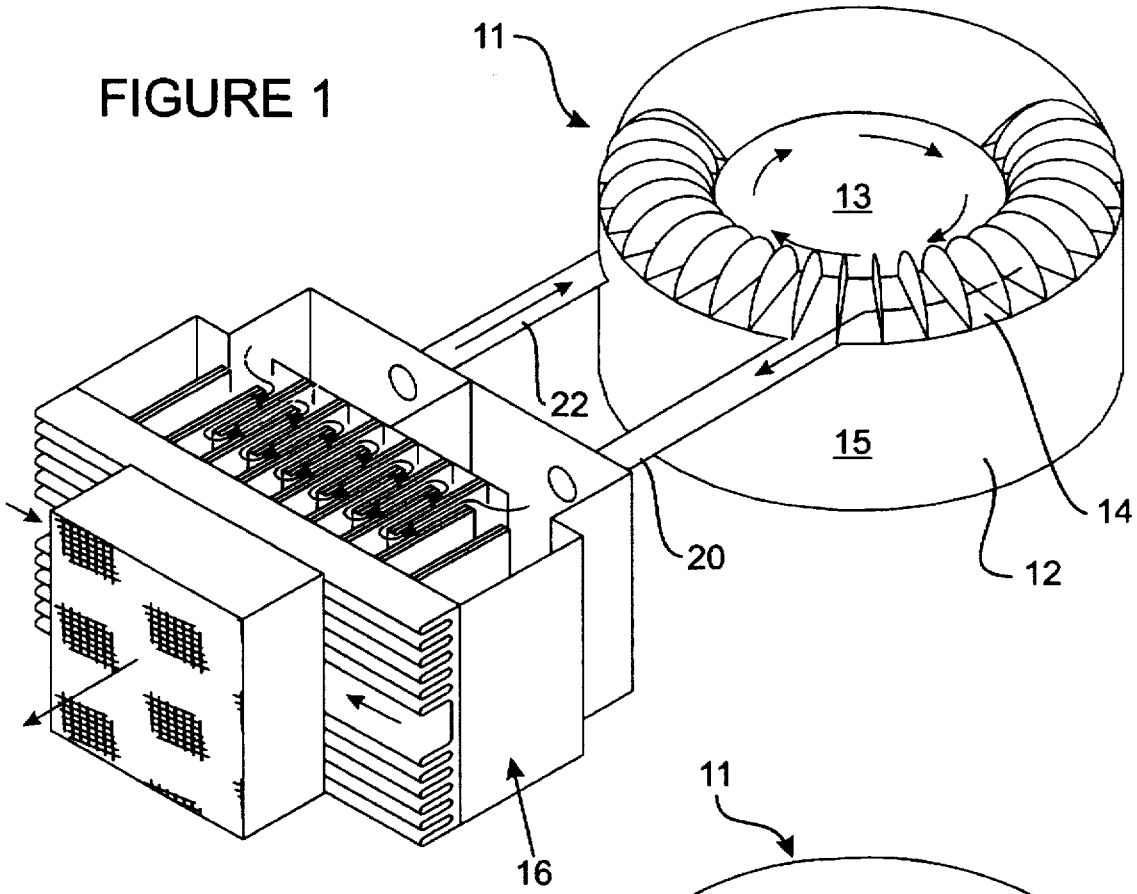
FIG. 1 is a schematic perspective view of the centrifuge chamber assembly of the present invention with a thermoelectric cooler liquid heat exchanges completely external of the centrifuge chamber.

Attention is now directed to both drawings which depict a centrifuge 11, generally, shaped cylindrically housing 12 and a rotor 13 therein. The housing 12 defines an annular space 14.

The housing 12 has a generally cylindrical shape having upstanding side walls 15. The centrifuge is detailed to carry a conventional centrifugal rotor 13. The centrifuge 11 may be detailed to have a conventional cover which may easily overlie and close the centrifuge or it may be hermetically sealed whereby a vacuum may be applied internally of the centrifuge, as desired.

The centrifuge 11 has in these configurations at least one thermoelectric module 16, external of the housing 12. The thermoelectric module 16 is of conventional construction having a cooling side and a heat sink side much in the manner of the aforementioned copending application and aforementioned and discussed prior art patents. The latter are incorporated herein by reference.

The centrifuge 11 is of conventional construction well known in the art with a floor and a base. A shaft from a vertically upstanding electric motor extends above the said base. A conventional rotor is keyed to the shaft of the motor for rotation in a conventional manner. It is pointed out that the thermoelectric modules 16 are of conventional construction and commercially available. In the present embodiments the thermoelectric modules 16 are connected to the housing 12 of the centrifuge by relatively short egress conduit 20 and relatively short ingress conduit 22. The egress conduit 20 is detailed to remove the ambient heated fluid about the rotor in the centrifuge for distribution to the thermoelectric cooler 16 where it is conventionally cooled. The cooled fluid is then returned to the centrifuge through ingress conduit 22.

Figure 2:
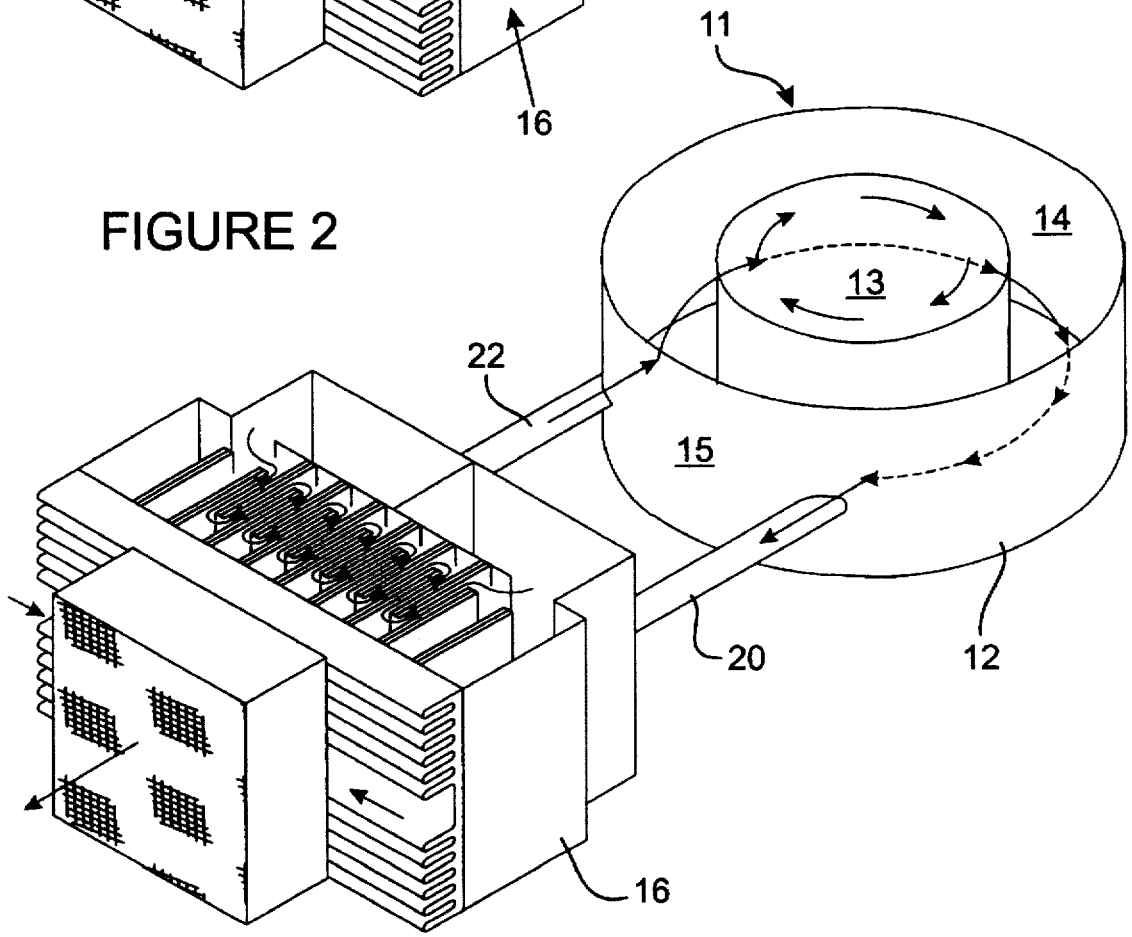
FIG. 2 is a schematic perspective view of the centrifuge chamber assembly of a second embodiment of he present invention with a thermoelectric cooler air heat exchanger completely external of the centrifuge chamber.

In the first embodiment as depicted in FIG. 1, the fluid is a liquid. The chamber is jacketed and is sealed and the ambient about the rotor is cooled by the transported cooled liquid. The module in this embodiment is supplied with a conventional suitable pump. The egress conduit and ingress conduit are liquid lines. In the embodiment of FIG. 2 the egress and ingress conduits are detailed to provide direct fluid access to the chamber so the hot ambient air is removed, cooled by the thermoelectric cooler and thence returned to the chamber through an ingress conduit 22.

What is claimed is:

1. A thermoelectrically cooled centrifuge comprising:

an electric motor driven rotor;

an hermetically sealable centrifuge housing adapted and constructed to contain said rotor;

a thermoelectric module having a cooling side and a heating side;

said centrifuge housing and said thermoelectric module being fluidly connected by an egress conduit and an ingress conduit;

said egress conduit having a pump means to move a fluid from said centrifuge housing to the cooling side of said thermoelectric module to thereby cool said fluid;

said ingress conduit having a pump means to move said fluid from said cooling side of said thermoelectric module to said centrifuge housing.

2. The thermoelectric cooled device of claim 1 wherein the fluid is a liquid.

3. The thermoelectric cooled device of claim 1 wherein the fluid is air.

4. The thermoelectric cooled device of claim 1 wherein the fluid is a liquid and the centrifuge includes a heat exchanger whereby the liquid is heated by ambient air in the centrifuge.

* * * * *